US006572703B1

(12) United States Patent
Crouch et al.

(10) Patent No.: US 6,572,703 B1
(45) Date of Patent: Jun. 3, 2003

(54) FABRIC MAKING APPARATUS

(75) Inventors: Earl T. Crouch, Greensboro, NC (US); Joe Nicholson, Kernersville, NC (US)

(73) Assignee: Highland Industries, Inc., Greensboro, NC (US)

( * ) Notice: Subject to any disclaimer, the term of this patent is extended or adjusted under 35 U.S.C. 154(b) by 0 days.

(21) Appl. No.: 10/152,596

(22) Filed: May 21, 2002

Related U.S. Application Data

(62) Division of application No. 09/479,678, filed on Jan. 7, 2000, now Pat. No. 6,405,418.

(51) Int. Cl.[7] ..... B05C 1/08

(52) U.S. Cl. ..... 118/211; 118/212; 118/641; 118/58; 118/60; 118/67; 118/68; 68/202

(58) Field of Search ..... 118/211, 212, 118/641, 58, 60, 67, 68; 68/202

(56) References Cited

U.S. PATENT DOCUMENTS 2,108,645 A * 2/1938 Bryant ..... 427/204
3,067,056 A * 12/1962 Remer ..... 427/152
3,167,850 A * 2/1965 Broderick ..... 68/202
3,685,323 A * 8/1972 Bosch et al. ..... 68/5 D
3,844,813 A * 10/1974 Leonard et al. ..... 28/169
3,908,250 A * 9/1975 Agan, Jr. et al. ..... 28/168
4,050,270 A * 9/1977 Vecchia ..... 68/158
4,087,993 A * 5/1978 Sando et al. ..... 26/18.5
4,448,582 A * 5/1984 Johnson ..... 8/149.1
4,452,607 A * 6/1984 Wessely ..... 26/18.5
4,474,552 A * 10/1984 Smith ..... 431/328
4,479,276 A * 10/1984 Ziegler ..... 68/158
4,551,995 A * 11/1985 Louison ..... 66/203
4,664,058 A * 5/1987 Schroeder et al. ..... 118/249
4,922,567 A * 5/1990 Miller ..... 68/13 R
5,007,253 A * 4/1991 Rahner ..... 66/149 R
5,205,140 A * 4/1993 Nielsen et al. ..... 26/28
5,673,727 A * 10/1997 Clear ..... 139/291 R
5,737,813 A * 4/1998 Sternlieb et al. ..... 28/163
5,980,582 A * 11/1999 Gehrlein et al. ..... 68/17 R
5,983,469 A * 11/1999 Beaty et al. ..... 28/105
6,343,410 B2 * 2/2002 Greenway et al. ..... 28/104

* cited by examiner

*Primary Examiner*—Laura Edwards
(74) *Attorney, Agent, or Firm*—MacCord Mason PLLC

(57) ABSTRACT

An apparatus for forming and finishing a continuous fabric web in a single operation. The apparatus includes a fabric web forming station for forming a continuous fabric web and a finishing station downstream from the fabric web forming station for receiving the continuous fabric web from the fabric web forming station and for providing a finishing treatment to the continuous fabric web. In the preferred embodiment, the finishing station includes a substantially excess-free applicator which helps to prevent thick spots in the coated fabric web which may occur when a coating applicator is stopped and restarted. In the preferred embodiment, the finishing station includes a curing station downstream from the applicator. The curing station may include both a drying station and a heat set station downstream from the drying station. The operating temperatures of the drying and heat set stations are controlled to minimize the amount of air having VOCs to be treated before being discharged into the atmosphere. Also in the preferred embodiment of the present invention is an accumulator located between the fabric web forming station and the finishing station for providing a fabric web reserve between the fabric web forming station and the finishing station. The accumulator includes a control system for varying the speed of the finishing station in response to the amount of the fabric reserve.

22 Claims, 15 Drawing Sheets

FABRIC MAKING APPARATUS

This application is a division of application Ser. No. 09/479,678 filed Jan. 7, 2000, now U.S. Pat. No. 6,405,418.

BACKGROUND OR THE INVENTION (1) Field of the Invention

The present invention relates generally to an apparatus for forming a continuous fabric web and, more particularly, to an apparatus for forming and finishing a continuous fabric web in a single operation and the product produced thereby.

(2) Description of the Prior Art

Warp knitting machines can produce large width continuous fabric webs at high speed. The fabric webs produced by such machines have many industrial applications but often are subsequently coated with another material, such as plastic, to produce a composite material. In this case, the fabric web acts as a substrate to give added strength and the plastic coating may be, for example, a print receptive coating for signage. However to improve the adherence of the coating, it is often desirable to pre-treat the fabric web with an intermediate coating before putting on the final plastic coating.

While warp knitting machines having widths greater than 72 inches are common and relatively inexpensive, finishing machines having widths greater than 72 inches become exponentially expensive. In addition, the costs associated with moving such wide rolls of fabric can add substantial cost per yard to the final material. Prior art attempts to integrate the fabric forming and finishing operations into a single operation have not been very successful. Specifically, it is very difficult to control the thickness of the coating operation unless the coating operation is continuous. However, by its nature, fabric forming must be stopped and started when defects, such as broken yams, occur.

Thus, there remains a need for an apparatus for forming and finishing a continuous fabric web which can be done in a single operation while, at the same time, the thickness of the pre-coating on the continuous fabric web can be precisely controlled even during starts and stops.

SUMMARY OF THE INVENTION

The present invention is directed to an apparatus for forming and finishing a continuous fabric web in a single operation. The apparatus includes a fabric web forming station for forming a continuous fabric web and a finishing station downstream from the fabric web forming station for receiving the continuous fabric web from the fabric web forming station and for providing a finishing treatment to the continuous fabric web. In the preferred embodiment, the fabric web forming station is a warp knitting machine having a creel and a plurality of yarn packages for supplying yarn to the warp knitting machine.

In the preferred embodiment, the finishing station includes a substantially excess-free applicator which helps to prevent thick spots in the coated fabric web which may occur when a coating applicator is stopped and restarted. The applicator of the present invention includes a liquid coating supply; an elongated pan extending across the width of the fabric web for containing the liquid coating; and an elongated knurled roller positioned in the pan in direct contact with the liquid coating and in direct contact with the bottom surface of the fabric web, whereby the rotation of the knurled roller transfers a predetermined amount of the liquid coating to the fabric web.

The volume of the grooves in the knurled surface of the knurled roller is proportional to the predetermined amount of the liquid coating being transferred to the fabric web. The predetermined amount of the liquid coating being transferred to the fabric web is substantially equal to the desired liquid take-up of the fabric web, thereby eliminating the need for removing excess liquid take-up from the fabric web.

To further control the accuracy of the amount of liquid being transferred from the knurled roller to the continuous fabric web, the deflection of the knurled roller is minimized in several ways. First, the bulk density of the knurled roller is less than about 3 times greater than the density of the liquid coating, thereby providing buoyancy to support the weight of the knurled roller. In the preferred embodiment the knurled roller is formed substantially from aluminum; however, the knurled roller could be jacketed with a high-density outer sheath and a low-density inner core. Second, a level control maintains the amount of liquid in the elongated pan at a predetermined level. Third, a deflection compensator attached to the knurled roller.

The deflection compensator is attached to the knurled roller includes a frame located at at least one end of the knurled roller, a journal extending outwardly from the knurled roller, a first bearing attached to the frame for receiving the journal, a second bearing located at the outermost end of the journal and a pneumatic cylinder linkage attached between the second bearing and the frame for providing a downward force to compensate for the deflection of the knurled roller.

In the preferred embodiment, the finishing station includes a curing station downstream from the applicator. The curing station may include both a drying station and a heat set station downstream from the drying station. In the preferred embodiment the drying station includes a heat drum having a temperature between about 180 F. and 225 F. to remove most of the moisture from the coated continuous fabric web but not to produce VOCs which occur during curing of the coating. Desirably, a temperature of about 212 F. will optimize the amount of moisture removed from the coated continuous fabric, while minimizing shrinkage of the fabric. A hood is located above the drying station for removing moisture driven off from the fabric web by the drying station. The airflow velocity of the hood is greater than about 400 CFM/ft of the width of the continuous fabric web which aids in drying the coated continuous fabric web. However, since the vapors include little or no VOCs, this large amount of air does not need to be treated further before being discharged into the atmosphere.

In the preferred embodiment, the heat set station includes a low thermal mass heat source which quickly cools when turned off. This permits the finishing station to be stopped and started as needed without burning the coated continuous fabric web. The heat set station also includes a hood located above the heat set station for removing VOCs driven off from the fabric web by the heat set station. Unlike the drying station, the airflow velocity of the hood is less than about 100 CFM/ft of the width of the continuous fabric web. This is a much smaller amount of air to be treated before being discharged into the atmosphere and results in substantial cost savings. In the preferred embodiment, the heat set station further includes a tenter frame for heat setting the continuous fabric web to a predetermined width.

Also in the preferred embodiment of the present invention is an accumulator located between the fabric web forming station and the finishing station for providing a fabric web reserve between the fabric web forming station and the finishing station. The accumulator includes a frame extending across the width of the continuous fabric web, a pair of arms each having one end attached to the frame on opposite edges of the continuous fabric web, a biased roller attached between the other ends of the pair of rollers and extending across the width of the continuous fabric web and a control system for varying the speed of the finishing station in response to the position of the accumulator arms.

Accordingly, one aspect of the present invention is to provide an apparatus for forming and finishing a fabric web in a single operation. The apparatus includes: a fabric web forming station for forming a continuous fabric web; and a finishing station downstream from the fabric web forming station for receiving the continuous fabric web from the fabric web forming station and for providing a finishing treatment to the continuous fabric web.

Another aspect of the present invention is to provide a finishing station for finishing a continuous fabric web, the finishing station including an applicator. The applicator includes: a liquid coating supply; an elongated pan extending across the width of the fabric web for containing the liquid coating; and an elongated knurled roller positioned in the pan in direct contact with the liquid coating and in direct contact with the bottom surface of the fabric web, whereby the rotation of the knurled roller transfers a predetermined amount of the liquid coating to the fabric web.

Still another aspect of the present invention is to provide an apparatus for forming and finishing a fabric web in a single operation. The apparatus includes: a fabric web forming station for forming a continuous fabric web; a finishing station downstream from the fabric web forming station for receiving the continuous fabric web from the fabric web forming station and for providing a finishing treatment to the continuous fabric web, the finishing station including: an applicator having (i) a liquid coating supply; (ii) an elongated pan extending across the width of the fabric web for containing the liquid coating; and (iii) an elongated knurled roller positioned in the pan in direct contact with the liquid coating and in direct contact with the bottom surface of the fabric web, whereby the rotation of the knurled roller transfers a predetermined amount of the liquid coating to the fabric web; and an accumulator between the fabric web forming station and the finishing station for providing a fabric web reserve between the fabric web forming station and the finishing station.

These and other aspects of the present invention will become apparent to those skilled in the art after a reading of the following description of the preferred embodiment when considered with the drawings.

DESCRIPTION OF THE PREFERRED EMBODIMENTS

Figure 1:
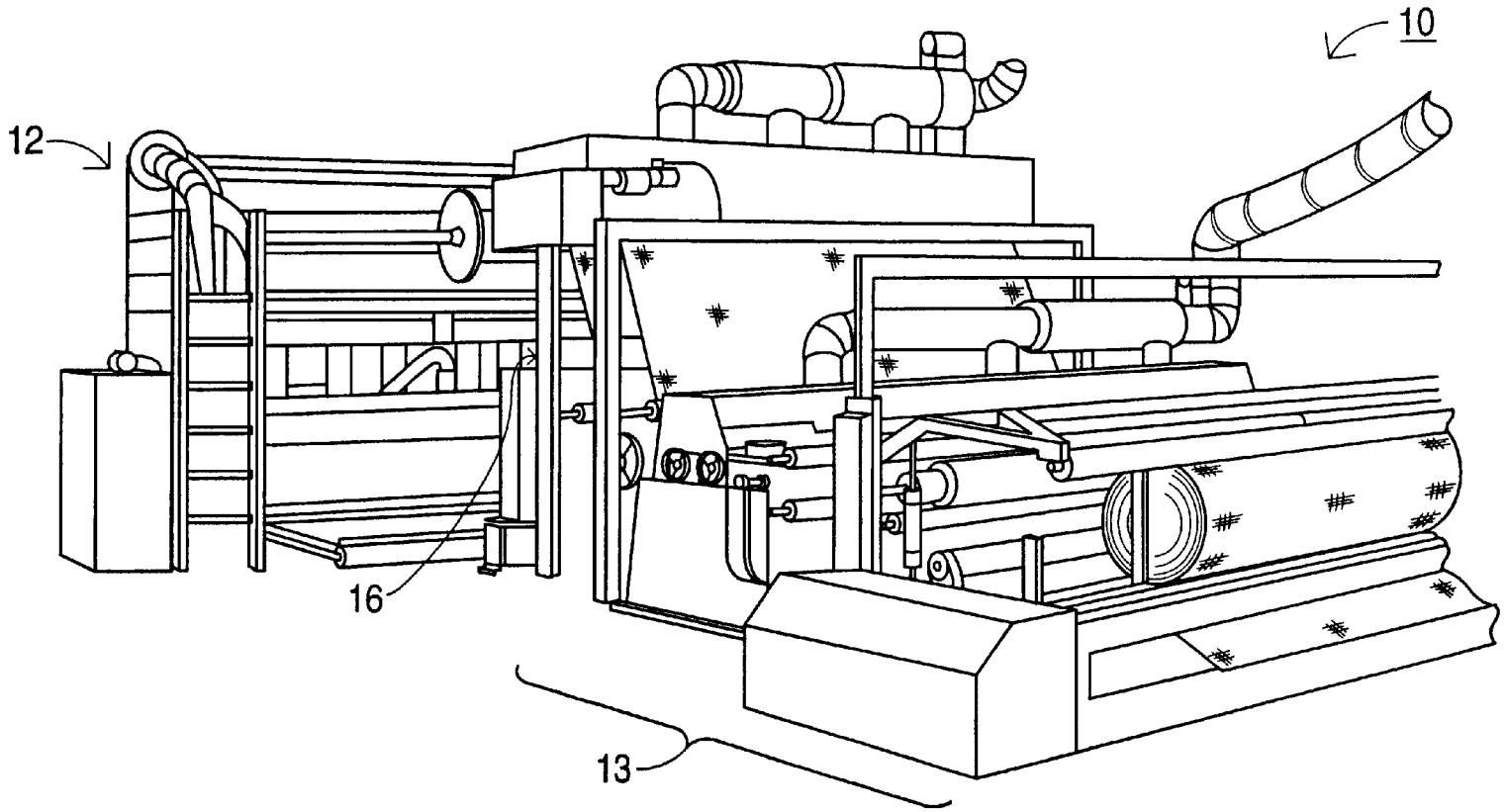
FIG. 1 is a perspective view of a fabric making apparatus constructed according to the present invention.

In the following description, like reference characters designate like or corresponding parts throughout the several views. Also in the following description, it is to be understood that such terms as "forward," "rearward," "left," "right," "upwardly," "downwardly," and the like are words of convenience and are not to be construed as limiting terms.

Figure 2:
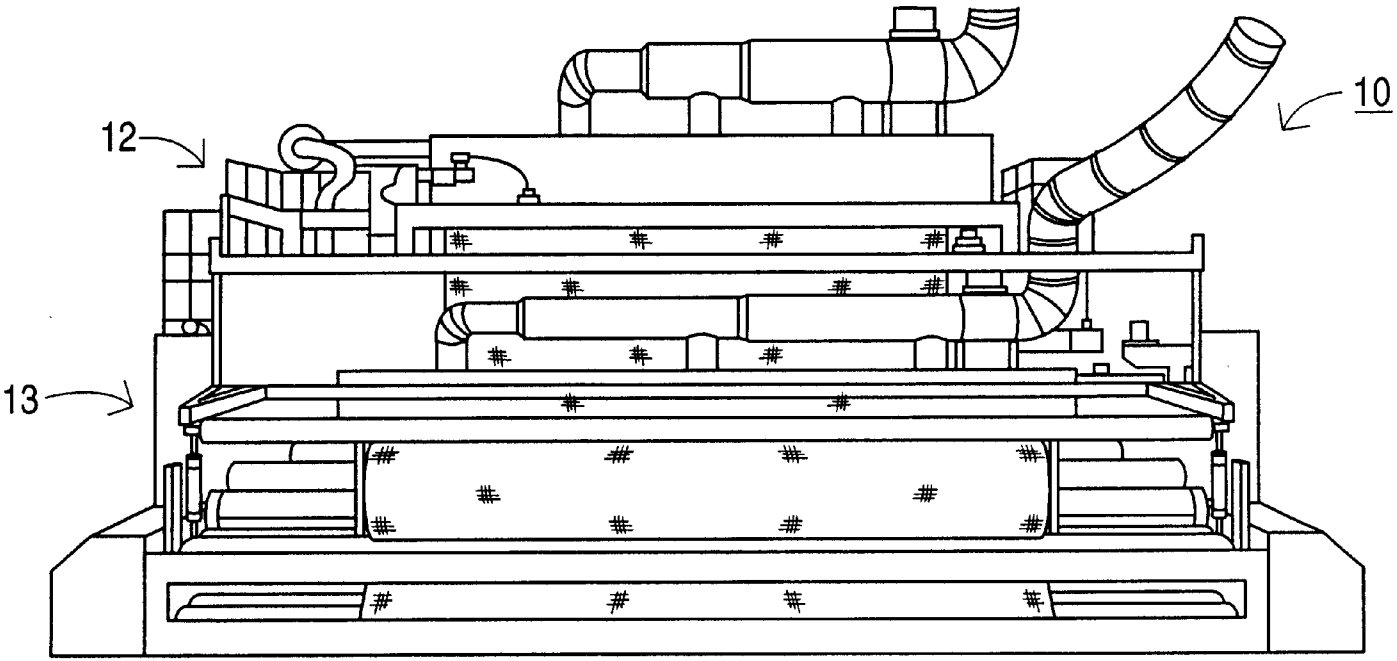
FIG. 2 is a front view of the apparatus shown in FIG. 1.

Referring now to the drawings in general and FIG. 1 in particular, it will be understood that the illustrations are for the purpose of describing a preferred embodiment of the invention and are not intended to limit the invention thereto. As best seen in FIGS. 1 and 2, a fabric making apparatus, generally designated 10, is shown constructed according to the present invention. The fabric making apparatus 10 includes three major sub-assemblies: a fabric web station 12; a finishing station 13; and an accumulator 16.

Figure 3A:
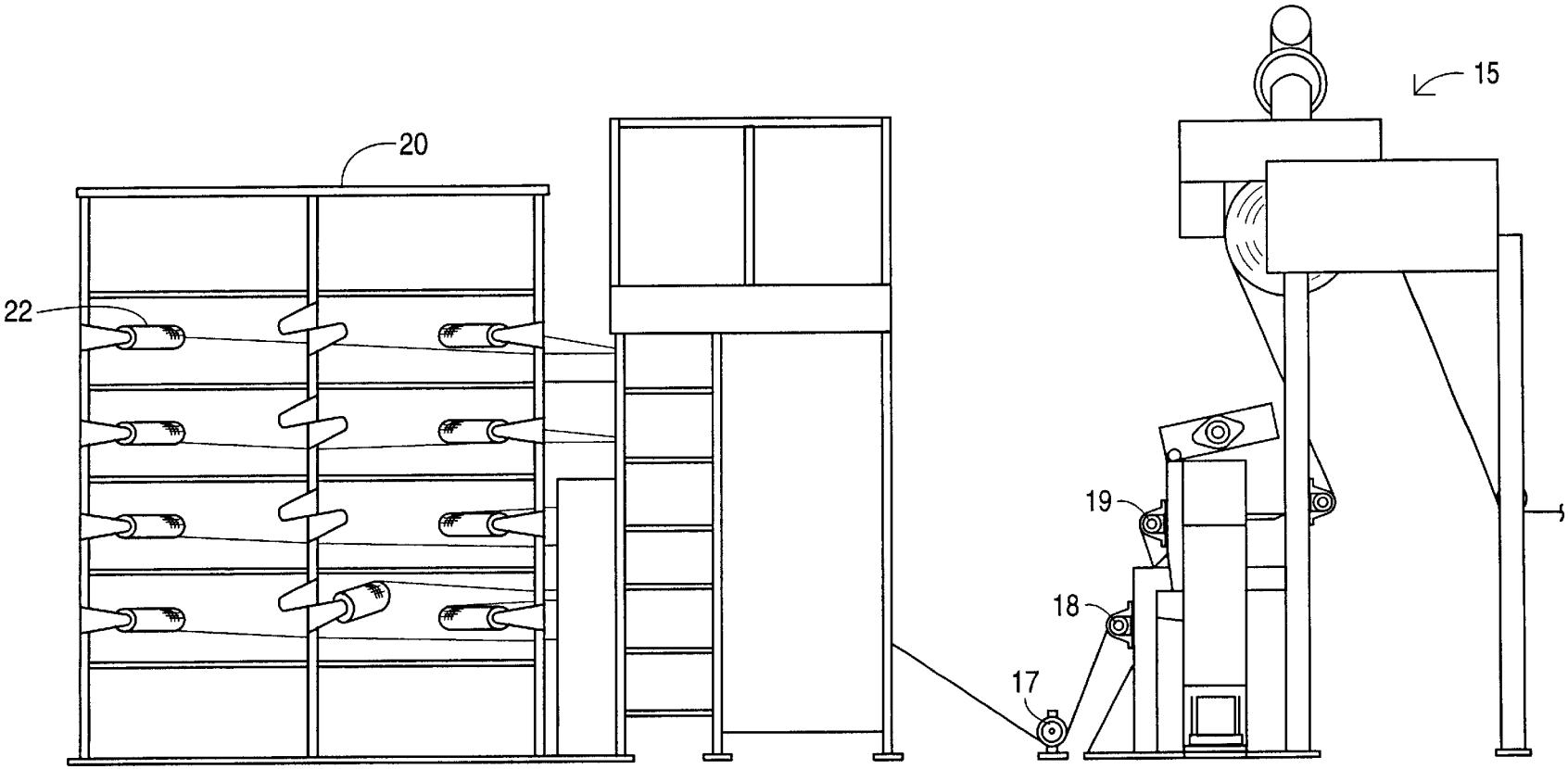
FIGS. 3A and 3B is a side view of the apparatus shown in FIG. 1.
Figure 3B:
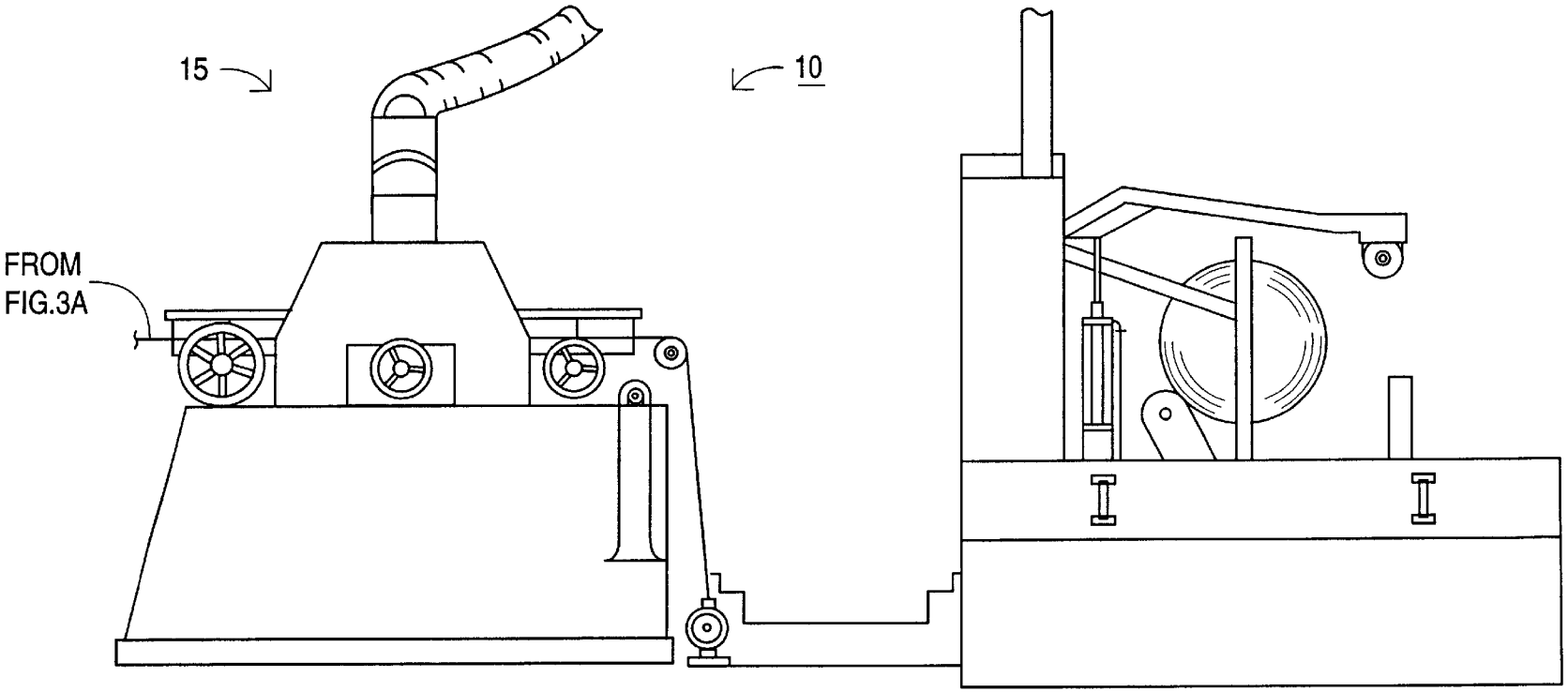

As best seen in FIG. 3, in the preferred embodiment, the fabric web forming station 12 is a warp knitting machine having a creel 20 and a plurality of yarn packages 22 for supplying yarn to the warp knitting machine. One such machine is available from LIBA Maschinenfabrik, Naila of West Germany. This machine is described in part by U.S. Pat. Nos. 4,154,068; 3,724,241; and 3,584,479 which are hereby incorporated by reference in their entirety. As discussed above, while warp knitting machines having widths greater than 72 inches are common and relatively inexpensive, finishing machines having widths greater than 72 inches become exponentially expensive. In addition, the overhead costs associated with moving such large rolls can add substantial cost per yard to the final material. This relationship can be best seen in FIG. 10 in which the fabric finishing costs increase at a much higher rate than the fabric forming costs. In the present invention, forming and finishing costs only increase at a slightly higher rate than forming alone. This may result in cost savings up to 25 cents per square yard.

Figure 4:
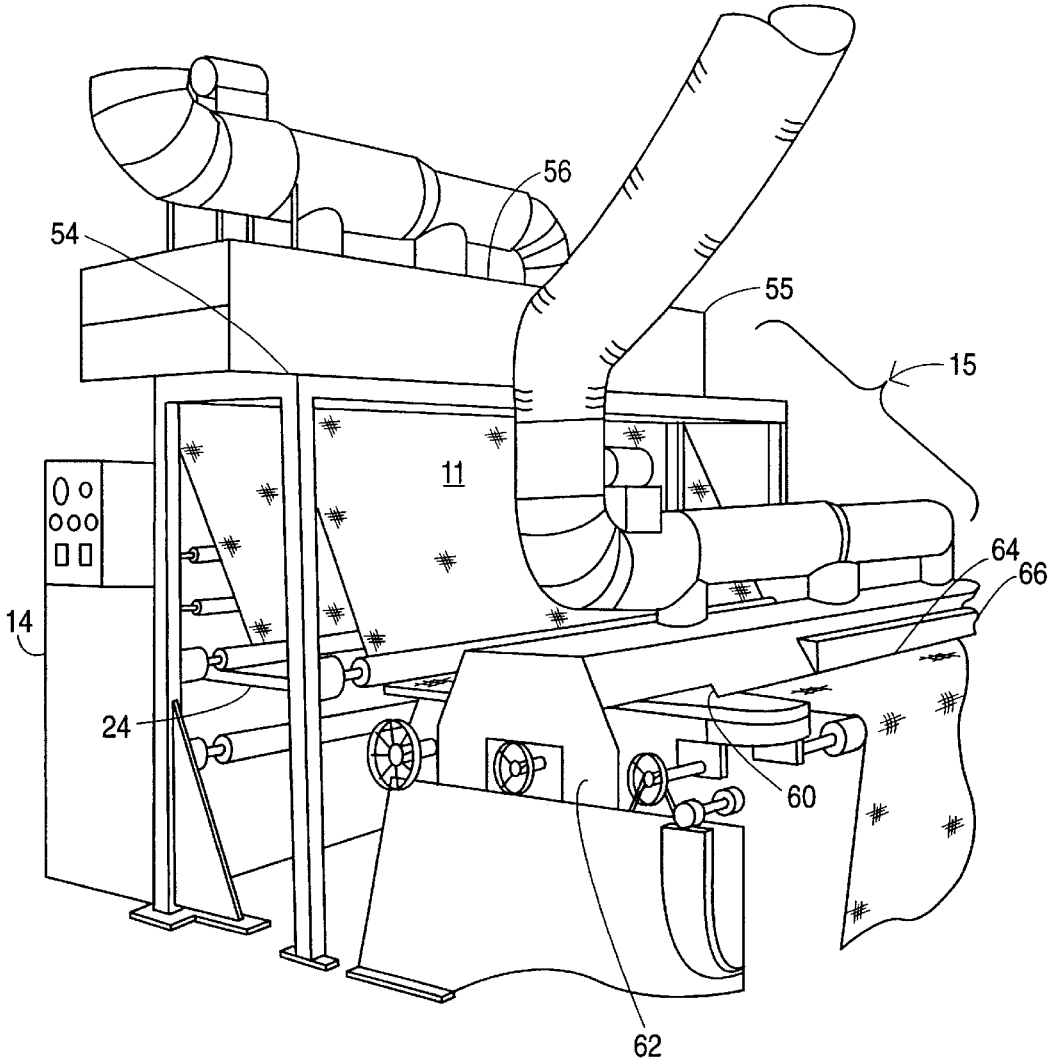
FIG. 4 is an enlarged front perspective view of the finishing station shown in FIG. 3.
Figure 5:
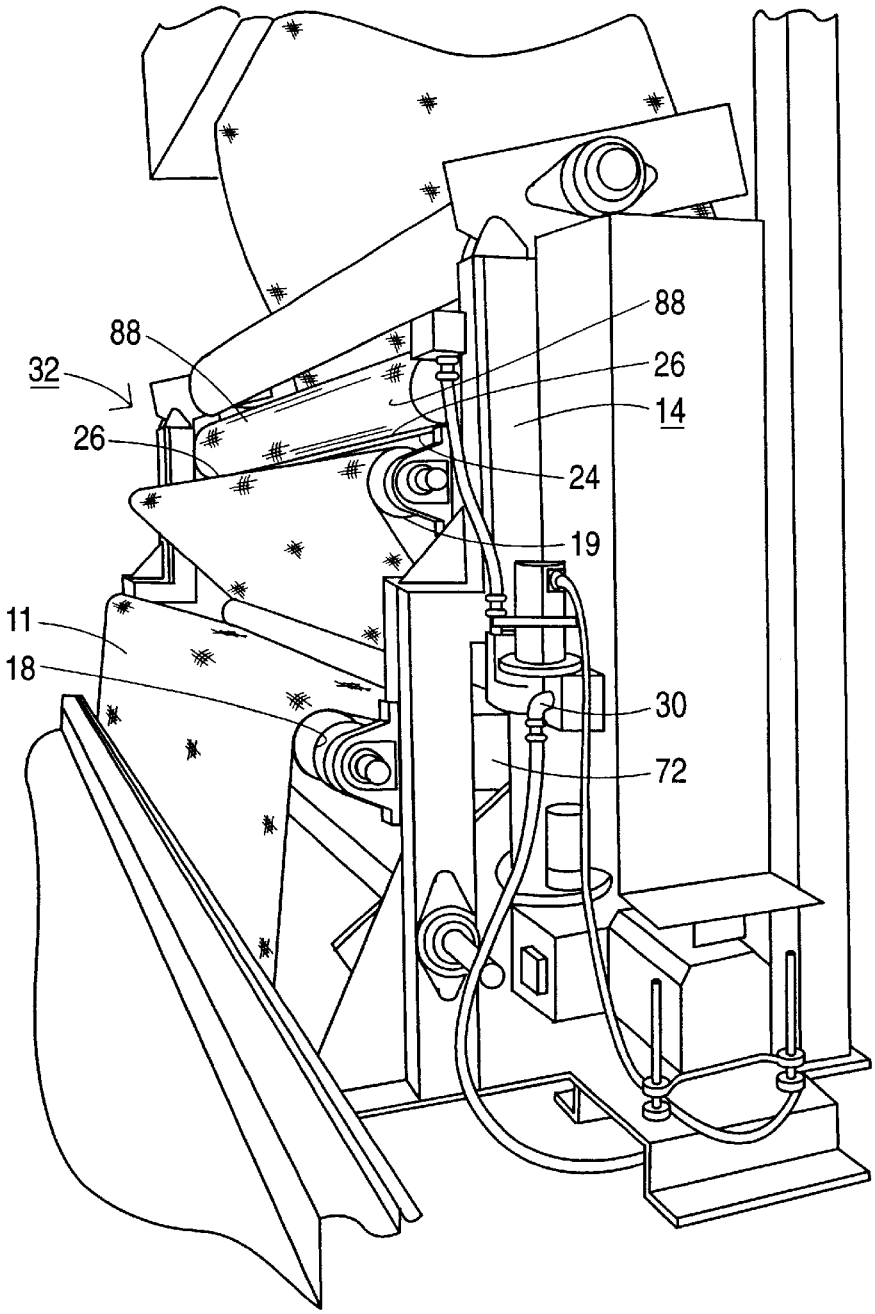
FIG. 5 is an enlarged rear perspective view of the finishing station applicator shown in FIG. 3.
Figure 13:
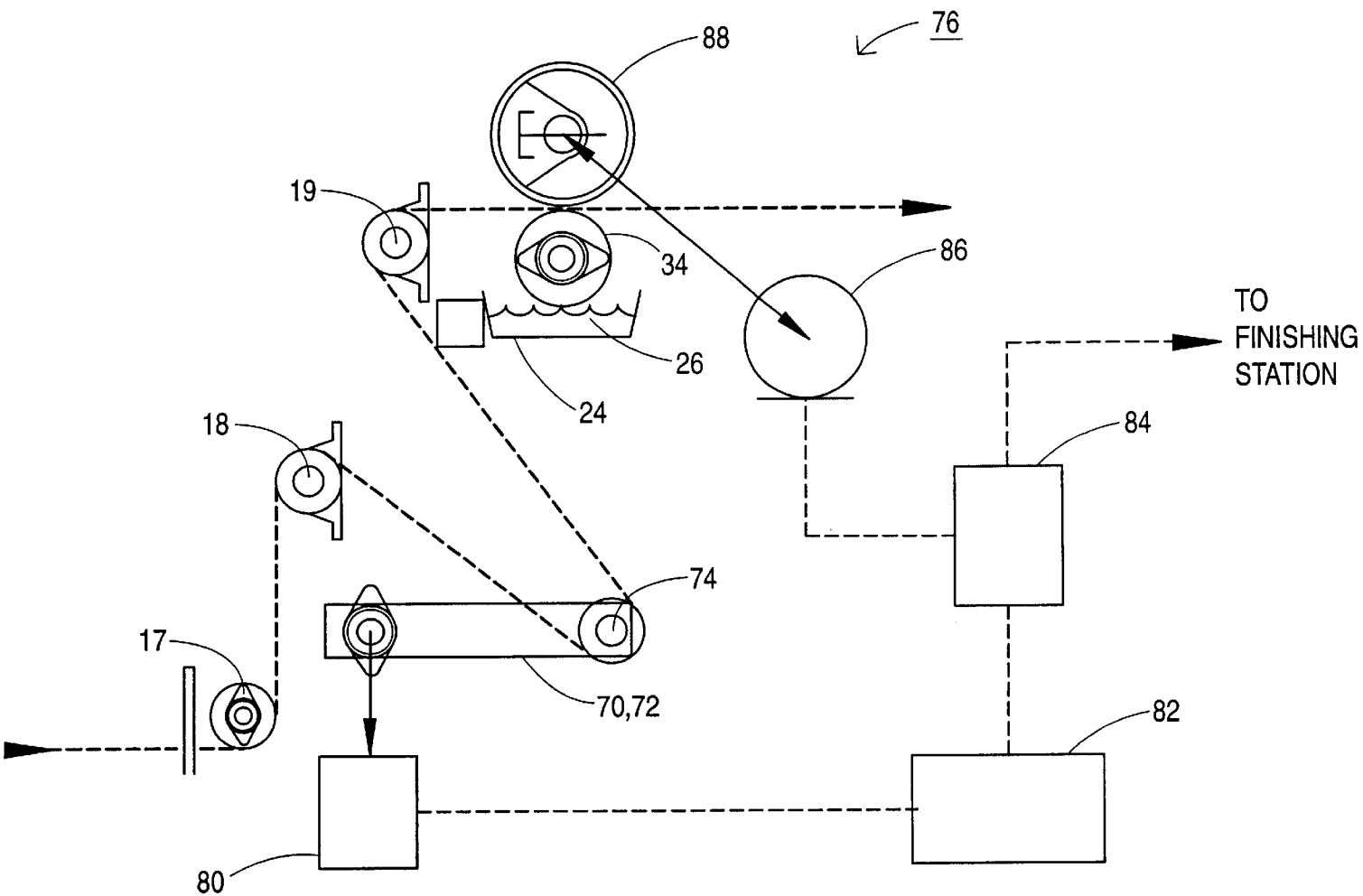
FIG. 13 is a diagram showing how the speed of the finishing station, shown in FIG. 4, is varied.

As seen in FIGS. 3A, 4 and 5, the finishing station 13 includes an applicator 14 and a curing station 15. As best seen in FIG. 13, fabric web 11 exiting the front face of the fabric forming station 12 passes under rollers 17 and 74 and over rollers 18 and 19 before feeding into finishing station 13 where a liquid coating 26 is applied to the fabric web 11 by the substantially excess-free applicator. In the preferred embodiment, the substantially excess-free applicator system includes a knurled roller assembly 32. As best seen in FIGS. 6B, 6C and 7, the knurled roller assembly includes a knurled roller 34 for picking up a liquid coating 26 contained in pan 24 by grooves 35 on the surface of the knurled roller 34 and evenly applied to continuous fabric web 11 passing across the top of the knurled roller 34.

The bulk density of the knurled roller 34 is less than about 3 times greater than the density of the liquid coating 26, thereby providing buoyancy to support the weight of the knurled roller 34. In the preferred embodiment the knurled roller 34 is formed substantially from aluminum; however, the knurled roller 34 could be jacketed with a high-density outer sheath and a low-density inner core. As seen in FIG. 5, a level control system 30 maintains an optimum level of liquid coating 26 in pan 24 such that knurled roller 34 is floatably supported.

Figure 6A:
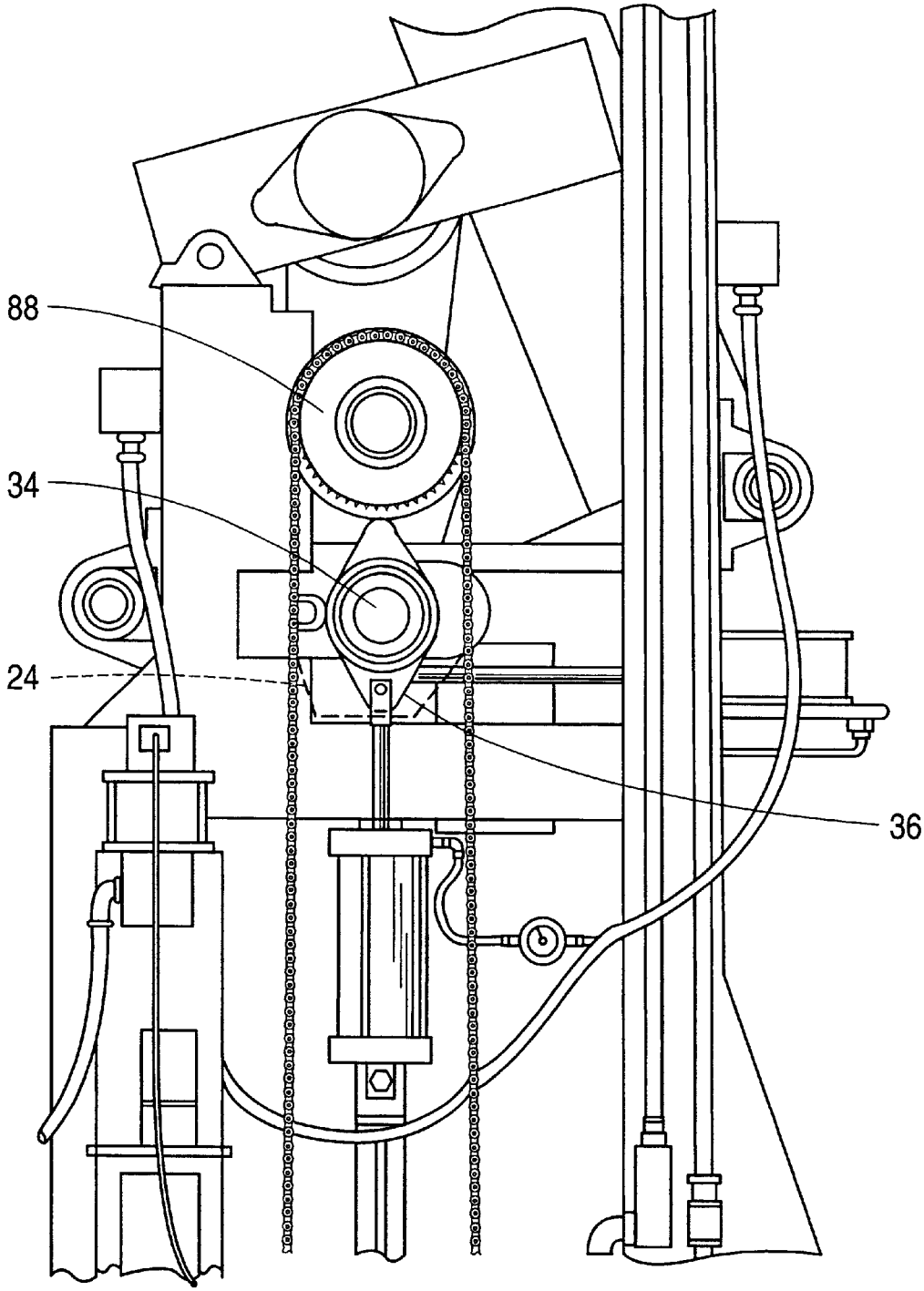
FIG. 6A is an enlarged side view of the finishing station applicator shown in FIG. 3.
Figure 6B:
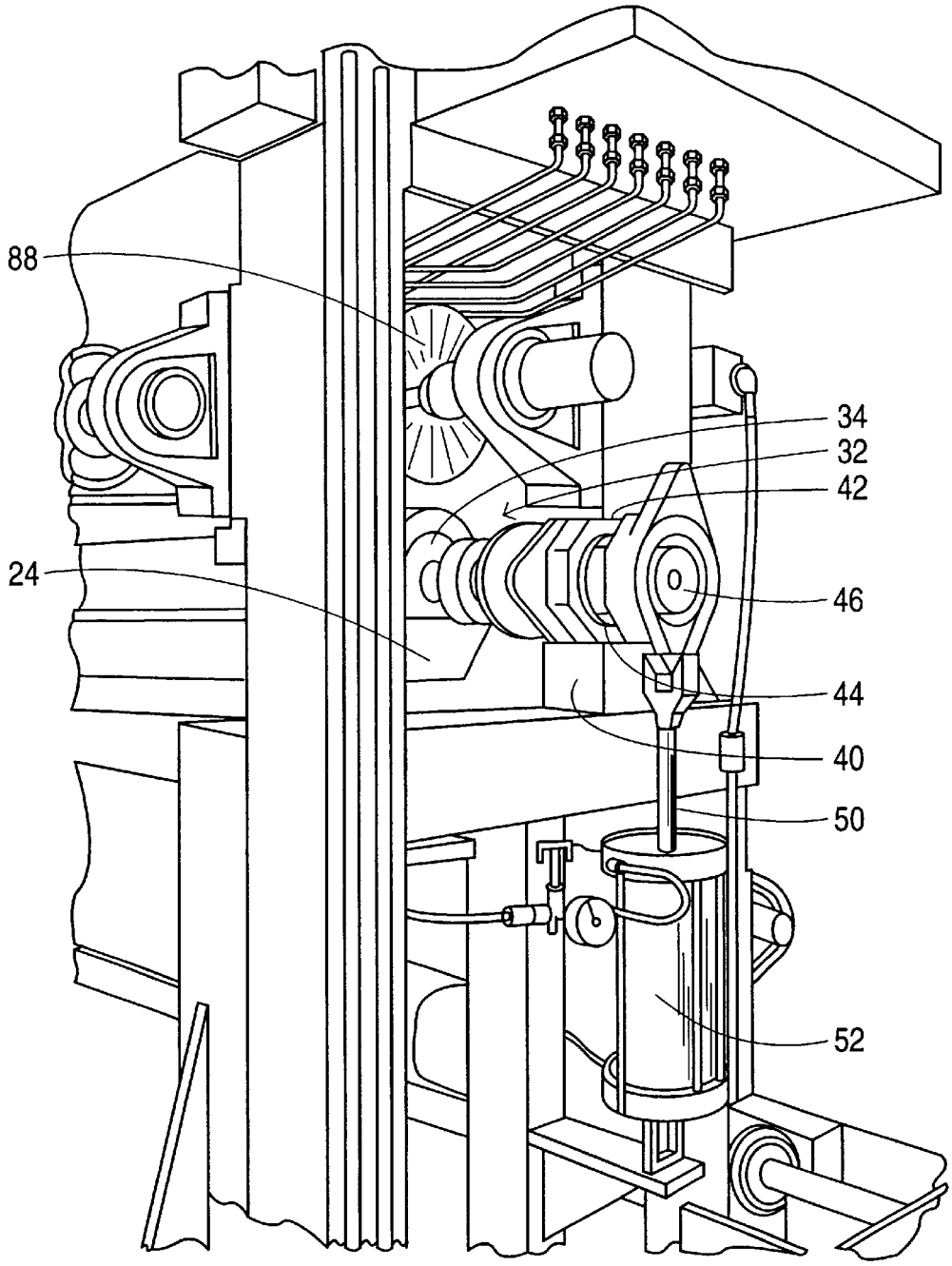
FIG. 6B is an enlarged side view of the opposite end of the finishing station applicator shown in FIG. 6A.
Figure 6C:
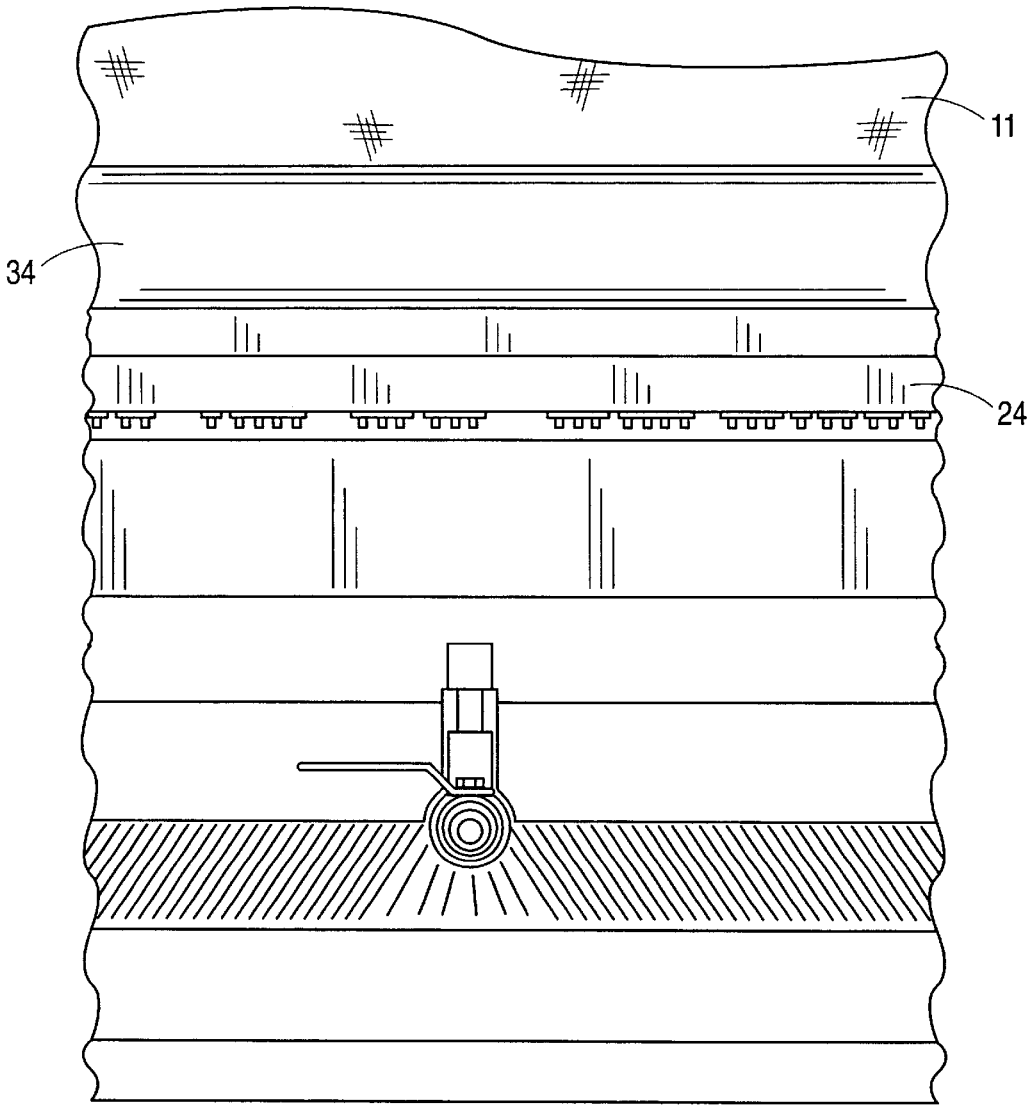
FIG. 6C is an enlarged front view of the finishing station applicator shown in FIG. 6A.
Figure 7:
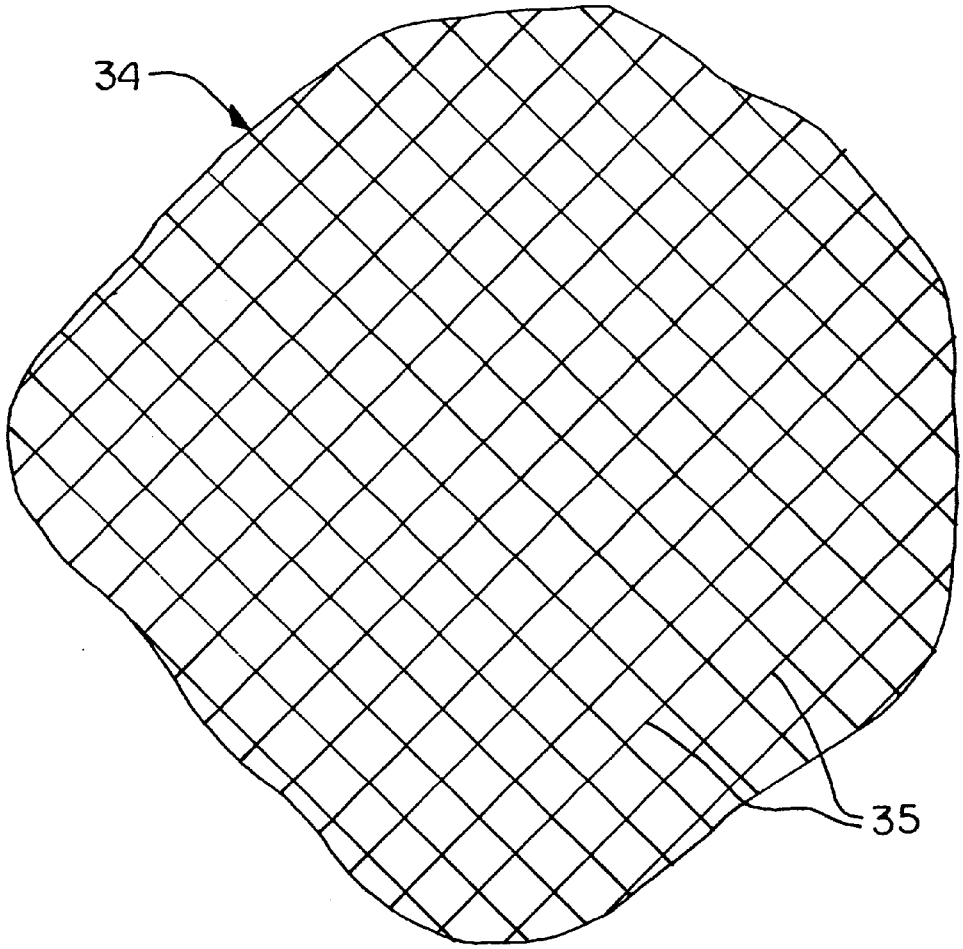
FIG. 7 is a greatly enlarged view of the knurled roller of the finishing station applicator shown in FIG. 6C.

As best seen in FIGS. 6A and 6B, a deflection compensator 36 also is provided to further prevent sagging of knurled roller 34. In the preferred embodiment, the deflection compensator 36 is comprised of a frame 40 which supports a pivotal first bearing 42, a journal 44, and a second bearing 46. A variable linkage 50 is attached to the second bearing 46 to vary the amount of force applied to knurled roller 34. In the preferred embodiment, an actuator 52 replaces or is attached to variable linkage 50.

Figure 11A:
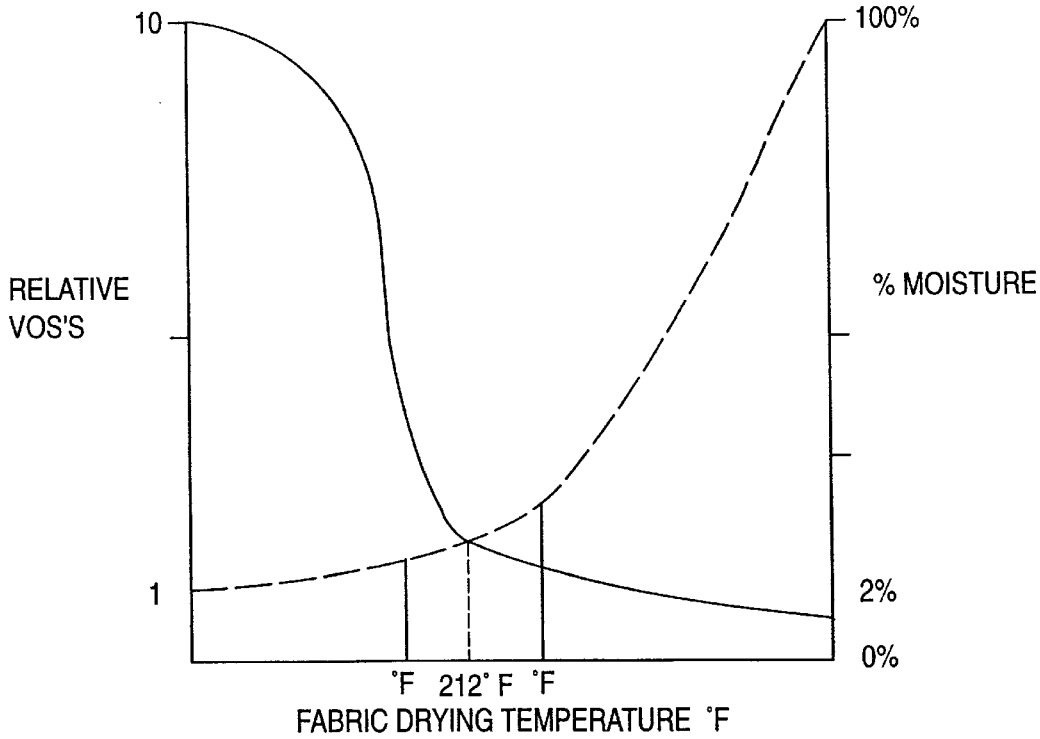
FIG. 11A is a chart showing the relationship between relative VOCs and fabric drying temperature, and between moisture percentage and fabric drying temperature.
Figure 11B:
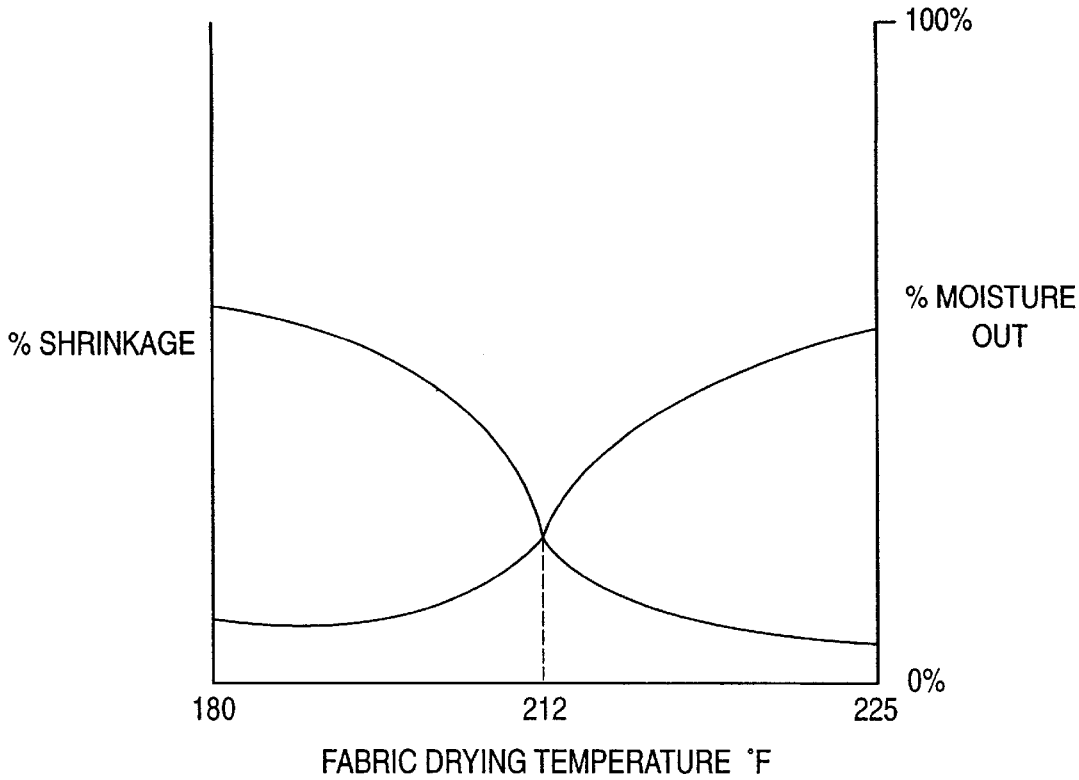
FIG. 11B is a chart showing shrinkage and moisture removed, and the relationship between shrinkage and moisture removal, as fabric drying temperature is varied.

Referring back to FIG. 4, in the preferred embodiment, curing station 15 is comprised of both a drying station 54 and a heat set station 60. The coated continuous fabric web 11 feeds into drying station 54 across heat drum 55 where moisture is substantially removed from the coated fabric. Ambient air is drawn through hood 56 mounted directly above heat drum 55 to aid in the drying process. The heat drum is maintained at a temperature between about 180 F. and about 225 F. to remove most of the moisture from the coated continuous fabric web but not to produce VOCs which occur during curing of the coating. This relationship can be best seen in FIG. 11A in which the moisture content decreases at a much higher rate than the VOCs emission rate. FIG. 11B shows how a heat drum temperature of approximately 212 F. optimizes moisture removal while minimizing shrinkage of the coated fabric.

The air flow velocity of the hood 56 is greater than about 400 CFM/ft of the width of the continuous fabric web 11 which aids in drying the coated continuous fabric web 11. However, since the vapors include little or no VOCs, this large amount of air does not need to be treated further before being discharged into the atmosphere.

Figure 12:
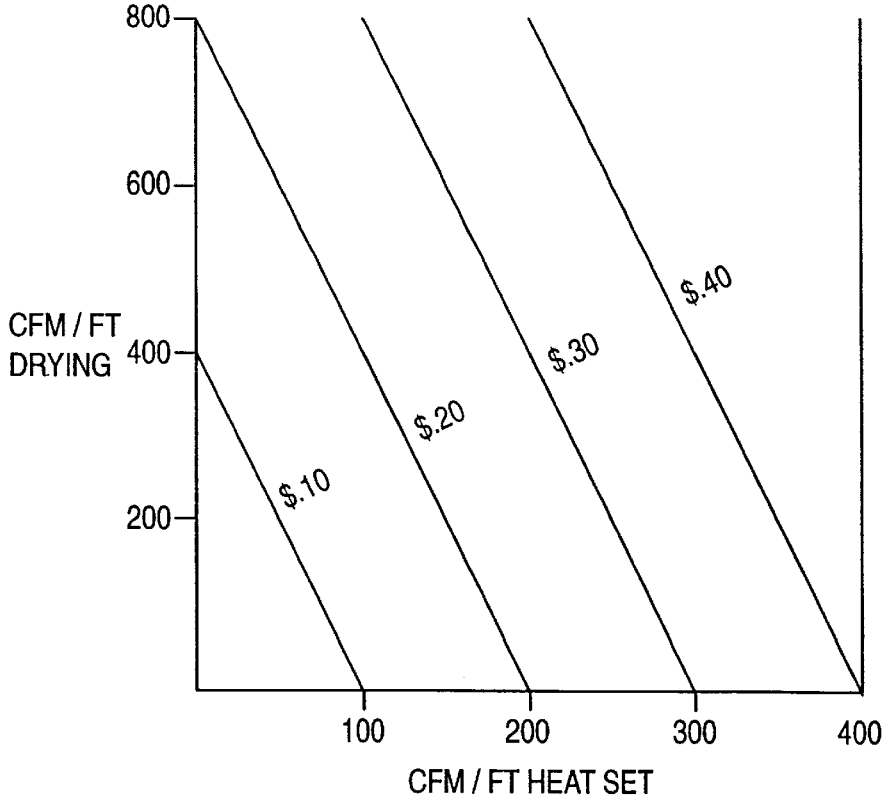
FIG. 12 is a chart showing the relative costs, in dollars, associated with various drying and heat set airflow velocities.

Downstream of heat drum 55, dried fabric web 11 is fed into heat set station 60 where the fabric web 11 passes under heaters 64 for final finishing. In the preferred embodiment, heaters 64 are low-mass infrared lights which quickly cool when turned off. This permits the finishing station 13 to be stopped and started as needed without burning the coated continuous fabric web 11. The heat set station 60 also includes a hood 66 located above the heat set station 60 for removing VOCs driven off from the fabric web 11 by the heat set station 60. Unlike the drying station 54, the airflow velocity of the hood is less than about 100 CFM/ft of the width of the continuous fabric web. This is a much smaller amount of air to be treated before being discharged into the atmosphere and results in substantial cost savings. This relationship can be best seen in FIG. 12 in which the relative process costs on a 1 to 5 scale are shown as a function of drying and heat set CFM rates per foot of fabric web. In the present invention, being able to use low CFM rates for heat setting keeps the total curing station cost low.

In the preferred embodiment, the heat set station 60 further includes a tenter frame 62 for heat setting the continuous fabric web 11 to a predetermined width. One such machine is available from Marshall & Williams Company of Greenville, S.C. This machine is described in part by U.S. Pat. No. 3,179,975 which is hereby incorporated by reference in its entirety. The fabric is then taken up on a conventional take-up unit such as that manufactured by Greenville Machinery Corporation of Greenville, S.C.

Figure 8:
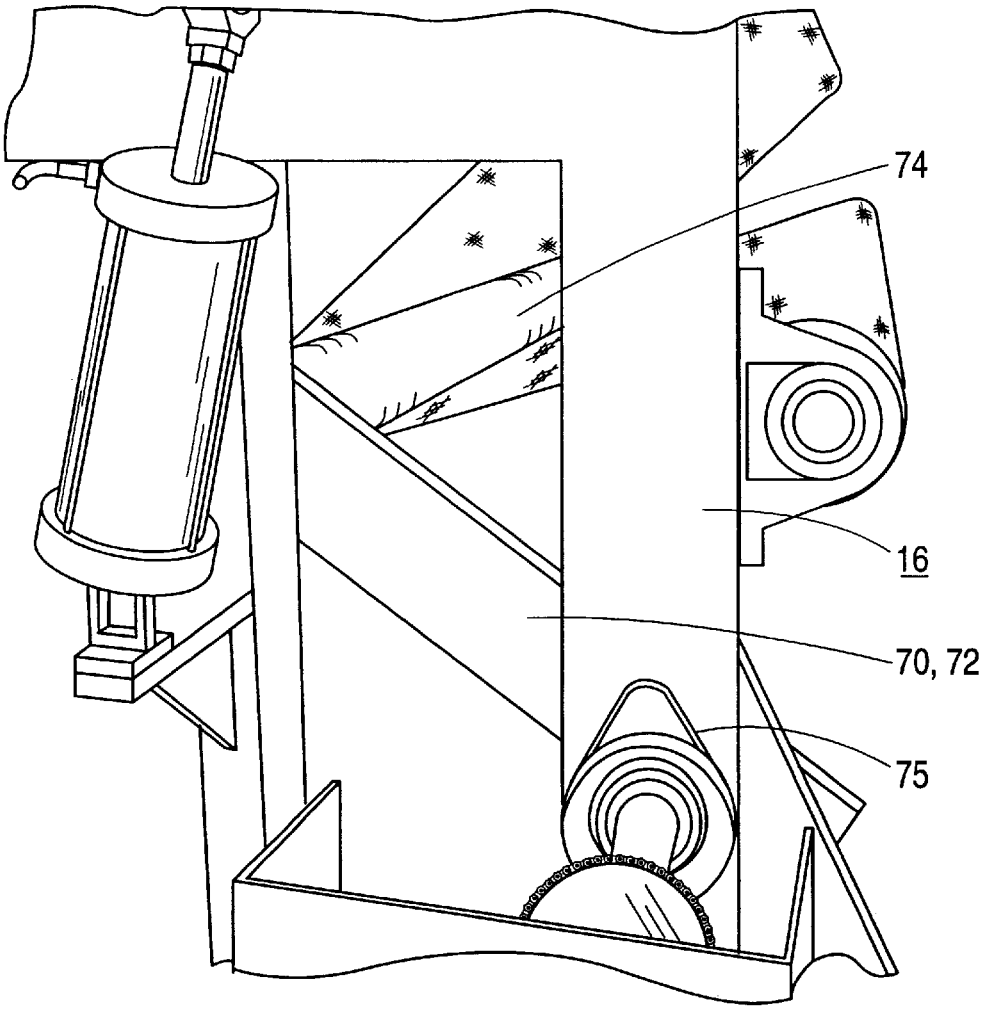
FIG. 8 is an enlarged side view of the accumulator shown in FIG. 3.
Figure 9:
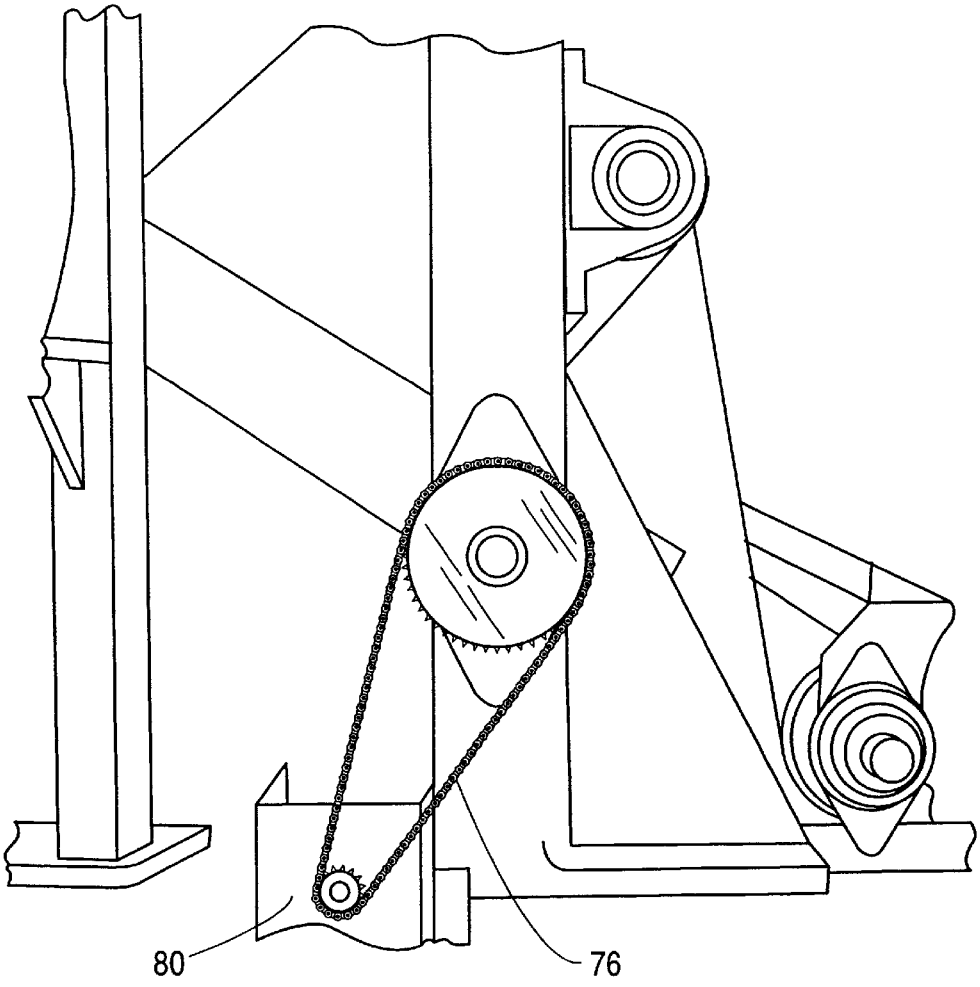
FIG. 9 is an enlarged side view of the control system for accumulator shown in FIG. 8.

In the preferred embodiment, the present invention also provides a fabric web reserve between the fabric making station 12 and the finishing station 13. As seen in FIGS. 8 and 9, accumulator 16 includes a biased roller 74 which is supported by two arms 70, 72 on a frame 75. A control system 76 includes a position sensor 80 for varying the speed of electric motor 86 and the finishing station 13 in response to the position of the accumulator arms 70, 72. As best seen in FIG. 13, position sensor 80 senses the relative position of accumulator arms 70, 72 and provides an input to a microprocessor 82. Microprocessor 82 provides an output signal to a DC electric voltage controller 84 which varies the speed of electric motor 86 and the finishing station 13. Electric motor 86 is coupled to and turns pulling roller 88. The lower the position of accumulator arms 70, 72, the higher the speed of electric motor 86. Conversely, as arms 70, 72 rise, the speed of electric motor 86 is reduced.

In operation, the fabric web 11 is formed by the warp-knitting machine 12 and passes to the finishing station 13. Fabric web 11 exiting the front face of the fabric forming station 12 passes under rollers 17 and 74 and over rollers 18 and 19 before feeding into finishing station 13 where the liquid coating 26 is applied to the fabric web 11 by the substantially excess-free applicator and knurled roller assembly 32. Level control system 30 maintains an optimum level of liquid coating 26 in pan 24 such that knurled roller 34 is floatably supported and deflection compensator 36 also further prevent sagging of knurled roller 34.

A fabric web reserve is provided between the fabric making station 12 and the finishing station 13 by accumulator 16. Control system 76 varies the speed of electric motor 86 and finishing station 13 in response to the position of the accumulator arms 70, 72.

The coated continuous fabric web 11 then feeds into drying station 54 across heat drum 55 where moisture is substantially removed from the coated fabric. Ambient air is drawn through hood 56 mounted directly above heat drum 55 to aid in the drying process.

Downstream of heat drum 55, the dried fabric web 11 is fed into heat set station 60 where the fabric web 11 passes under heaters 64 for final finishing by the tenter frame 62 for heat setting the continuous fabric web 11 to a predetermined width.

Figure 10:
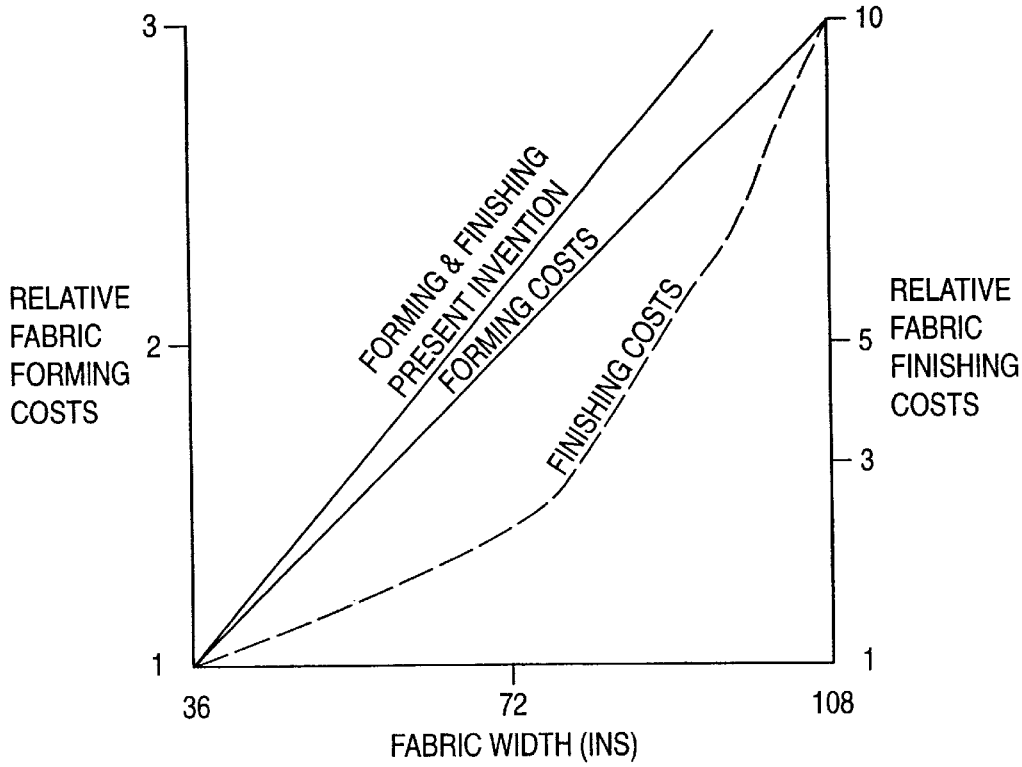
FIG. 10 is a chart showing the relationship between relative fabric forming costs and fabric width.

The present invention is able to use relatively common warp knitting machines having widths greater than 72 inches without the need for very expensive finishing machines having widths greater than 72 inches. In addition, the overhead costs associated with moving such large rolls are substantially reduced as shown in FIG. 10 in which the fabric finishing costs increase at a much higher rate than the fabric forming costs. Specifically, in the present invention, forming and finishing costs only increase at a slightly higher rate than forming alone thereby resulting in cost savings up to 25 cents per square yard.

In addition, the present invention provides a measurably superior coated fabric web when compared to a standard tenter frame coated fabric web in which the,fabric web is separately formed and then finished on the tenter frame and to a conventional high speed finishing, tenter frame system. Samples of all three processes were tested for yarn uniformity in the warp and weft directions shown in Table 1.

TABLE 1

| | WARP DIRECTION | | | WEFT DIRECTION | | |
|---|---|---|---|---|---|---|
| PROCESS | Spacing | SD | % Var | Spacing | SD | % Var |
| Present Invention | 2.03 mm | 0.05 | 3 | 1.77 mm | 0.08 | 5 |
| Tenter Frame (I ) | 2.04 mm | 0.12 | 6 | 1.82 mm | 0.30 | 16 |
| Tenter Frame (II) | too curvy to measure | | | too curvy to measure | | |

As can be seen, the tenter frame standard deviation is between about 2½ and 4 times greater than that of the present invention. The high speed finishing, tenter frame system was so curvy as not to be meaningfully measurable. Handling alone appears to be the cause of the tenter frame variability. However, speed appears to be a major contributor for the high speed finishing, tenter frame system process. Specifically, the present invention operates between about 1 and 4 yards per minute and preferably at bout 3 yards per minute. In contrast, the high speed process operates at about 90 yards per minute. Accordingly, the present invention avoids both of these problems and produces a continuous fabric web finished in a single operation which is substantially distortion free. Specifically, the variation in the warp direction of the finished fabric web is less than about 3% (0.05 SD (standard deviation)/2.03) and the variation in the weft direction of the finished fabric web is less than about 5% (0.08 SD/1.77).

Thus, the present invention is able to produce a continuous fabric web finished in a single operation is which the finished fabric web is substantially distortion free. Compared to the prior art, the variation in the warp direction of the finished fabric web is less than about 6% and, preferably, less than about 3%. In addition, the variation in the weft direction of the finished fabric web is less than about 16% and, preferable, less than about 5%.

In the preferred embodiment, the finished fabric web is a warp knit fabric and, preferable, is a weft inserted, warp knit fabric. The finished fabric web is formed from synthetic yarn which, unlike fiberglass-type yarns, are much more difficult to stabilize. Preferably, the finished fabric web is formed from polyester yarn. The present invention is thus able to produce a finished fabric web greater than about 72 inches wide and, preferably, greater than about 96 inches wide or greater than about 120 inches wide depending on the width of the knitting machine.

Certain modifications and improvements will occur to those skilled in the art upon a reading of the foregoing description. By way of example, rollers could be put inside the coating pan to provide additional support for the knurled roller. Also, the coating could be applied to the fabric by other techniques such as spraying, or dipping and squeezing. It should be understood that all such modifications and improvements have been deleted herein for the sake of conciseness and readability but are properly within the scope of the following claims.

We claim:

1. A finishing station for finishing a continuous fabric web, said finishing station including an applicator, said applicator comprising:

(a) a liquid coating supply;

(b) an elongated pan extending across a width of said fabric web for containing said liquid coating;

(c) an elongated knurled roller positioned in said pan in direct contact with said liquid coating and in direct contact with a bottom surface of said fabric web, whereby rotation of said roller transfers a predetermined amount of said liquid coating to said fabric web; and (d) a deflection compensator attached to said roller.

2. The apparatus according to claim 1, wherein said liquid coating is a polyvinyl chloride solution.

3. The apparatus according to claim 1, wherein bulk density of said roller is less than about 3 times greater than the density of said liquid coating, thereby providing buoyancy to support the weight of said roller.

4. The apparatus according to claim 3, wherein said roller is formed substantially from aluminum.

5. The apparatus according to claim 3, wherein said roller is jacketed with a high-density outer sheath and a low-density inner core.

6. The apparatus according to claim 1, further including a level control for maintaining the amount of liquid in said elongated pan at a predetermined level.

7. The apparatus according to claim 1, wherein said deflection compensator attached to said roller includes a frame located at least one end of said roller, a journal extending outwardly from said roller, a first bearing attached to said frame for receiving said journal, a second bearing located at the outermost end of said journal and a linkage attached between said second bearing and said frame for providing a downward force to compensate for the deflection of said roller.

8. The apparatus according to claim 7, wherein a lenght of said linkage is variable.

9. The apparatus according to claim 8, wherein said linkage includes a pneumatic cylinder for varying the length of said linkage.

10. The apparatus according to claim 1, further including a curing station downstream from said applicator.

11. The apparatus according to claim 10, wherein said curing station includes a drying station and a heat set station downstream from said drying station.

12. The apparatus according to claim 11, wherein said drying station includes a heat drum.

13. The apparatus according to claim 12, wherein temperature of said heat drum is between about 180 F. and 225 F.

14. The apparatus according to claim 11, further including a hood located above said drying station for removing moisture driven off from said fabric web by said drying station.

15. The apparatus according to claim 14, wherein air flow velocity provided by said hood is greater than about 400 CFM/ft of the width of said continuous fabric web.

16. The apparatus according to claim 11, wherein said heat set station includes a low thermal mass heat source.

17. The apparatus according to claim 16, wherein said low thermal mass heat source is infrared lights having a power of about 2 KW/ft of the width of said continuous fabric web.

18. The apparatus according to claim 11, further including a hood located above said heat set station for removing VOCs driven off from said fabric web by said heat set station.

19. The apparatus according to claim 18, wherein air flow velocity provided by said hood is less than about 100 CFM/ft of the width of said continuous fabric web.

20. The apparatus according to claim 11, wherein said heat set station further includes a tenter frame for heat setting said continuous fabric web to a predetermined width.

21. The apparatus according to claim 1, wherein volume of said grooves in said knurled surface of said roller is proportional to said predetermined amount of said liquid coating being transferred to said fabric web.

22. The apparatus according to claim 21, wherein said predetermined amount of said liquid coating being transferred to said fabric web is substantially equal to a desired liquid take-up of said fabric web, thereby eliminating the need for removing excess liquid take-up from said fabric web.

* * * * *